US005220887A

United States Patent [19]

Hiddleston et al.

[11] Patent Number: 5,220,887

[45] Date of Patent: Jun. 22, 1993

[54] MODULAR VERTICAL TUBE TANK AND METHOD OF MANUFACTURE

[75] Inventors: Weldon M. Hiddleston; Charles L. Adams, both of Fort Worth, Tex.

[73] Assignee: PVI Industries, Inc., Fort Worth, Tex.

[21] Appl. No.: 869,513

[22] Filed: Apr. 16, 1992

[51] Int. Cl.[5] ..... F22B 7/18

[52] U.S. Cl. ..... 122/17; 126/361; 165/82; 122/14

[58] Field of Search ..... 122/13.1, 16, 17, 18, 122/19, 14; 126/361; 165/82

[56] References Cited

U.S. PATENT DOCUMENTS 2,059,371 11/1936 Legg ..... 122/17

2,448,128 8/1948 Trageser ..... 122/17

FOREIGN PATENT DOCUMENTS 2348009 3/1975 Fed. Rep. of Germany ..... 165/82

*Primary Examiner*—Albert W. Davis, Jr.

*Attorney, Agent, or Firm*—Charles D. Gunter, Jr.

[57] ABSTRACT

An improved water heater is shown which includes a water heating tank having external cylindrical sidewalls, an interior, and initially open upper and lower ends. A combustion chamber is connectable to the water heating tank and houses a burner for the combustion of a selected fossil fuel. A fire tube unit of a fixed length is received within the interior of the water heater tank and has an upper transverse wall section, a lower transverse wall section and interconnecting fire tubes. The fire tubes have open interiors which receive the products of combustion from the combustion chamber for heating water contained in the water heating tank. Flanges and resilient seals are located at the upper and lower ends of the water heating tank for securing the fire tube unit within the interior thereof. The resilient seals can be selectively sized to accommodate dimensional tolerances which occur between the fixed length of the fire tube unit and the water heater tank, allowing the components to be assembled in modular fashion.

8 Claims, 3 Drawing Sheets

MODULAR VERTICAL TUBE TANK AND METHOD OF MANUFACTURE

BACKGROUND OF THE INVENTION

1. Field of the Invention

The present invention relates generally to water heaters or boilers and, more specifically, to a method of manufacturing a modular vertical tube tank for such a water heater or boiler which can be coated for corrosion protection prior to assembly.

2. Description of the Prior Art

Water heaters and boilers (referred to collectively as water heaters in the discussion which follows) typically have a water heater tank, often of the vertical tube type which utilizes fire tubes located above a combustion chamber. Vertical shell or V-shell heat exchangers of the above type are well known in the industry. In these water heaters, a fossil fuel power burner may be used in the combustion chamber. The products of combustion from the combustion chamber pass vertically upward through the open interiors of the vertical tubes and out a flue outlet.

In the past, the vertical tube sheet and surrounding shell were an integral unit. A head was welded on each of the initially open ends of the generally cylindrical shell, each head having a plurality of aligned apertures. A plurality of vertical tubes were then inserted into the aligned apertures and welded into place.

In order to provide potable water, it was generally necessary to line the interior of the shell and the exterior of the vertical tubes with a corrosion inhibitor. For instance, the fire tubes could be clad on the water side with pure copper sheathing. Another coating used in the industry is electroless nickel which is a nonferrous, corrosion resistant shield. In certain of the prior art processes, the interior of the shell and the water side of the fire tubes were coated by a slush coating process in which the coating was applied through an opening such as the water inlet or outlet in the shell with the unit being rotated or agitated until the coating had uniformly distributed itself.

One problem with the prior art coating technique was that it was not possible to adequately inspect the inside of the slush coated water heater tank since the only openings into the previously welded tank were of relatively small diameter and the tank heads and vertical tubes had been welded into place. Another problem with slush coating was that such coatings typically had volatile organics which exceeded currently allowable VOC emission standards under applicable EPA guidelines.

The present invention has as its object to provide an improved vertical tube tank for a vertical shell and tube heat exchanger of the type used in water heater and boiler design.

Another object of the invention is to provide a vertical tube tank for a water heater having a tank and tube sheet of modular design.

Another object of the invention is to provide a manufacturing method for such a water heater which allows visual inspection of the corrosion resistant coating prior to assembly of the modular components into the completed device.

Another object of the invention is to provide a manufacturing method for such a water heater which allows the components of the shell and tube sheet to be coated by an electrostatic coating process, thereby obviating the need for slush coating techniques with high VOC emissions.

SUMMARY OF THE INVENTION

The improved water heater of the invention has a water heating tank having an external, generally cylindrical sidewall, an internal diameter and initially open upper and lower ends. A combustion chamber is connectable to the water heating tank. A burner is located in the combustion chamber for the combustion of a selected fossil fuel.

A fire tube unit is slidably received within the interior of the water heating tank, the fire tube unit having a fixed length, an upper transverse wall section and a lower transverse wall section. A plurality of fire tubes interconnect the upper and lower transverse wall sections. Each fire tube has an open interior, the open interiors of the fire tubes being adapted to receive the products of combustion from the combustion chamber when the combustion chamber is connected to the water heating tank.

Flange means are located adjacent the initially open upper and lower ends of the water heating tank for securing the fire tube unit within the interior of the water heater tank. Resilient seal means are provided for sealingly engaging a selected one of the upper and lower transverse wall sections of the fire tube unit when the fire tube unit is received within the interior of the water heating tank. The resilient seal means are selectively sized to accommodate dimensional tolerances which occur between the fixed length of the fire tube unit and the flange means located at the respective upper and lower ends of the water heater tank.

Preferably, the flange means includes an external flange located adjacent the initially open lower end of the water heating tank, the external flange being provided with bolt holes for receiving connecting bolts which bolt the external flange to the lower transverse wall section of the fire tube unit. The flange means also preferably includes an internal flange provided adjacent the initially open upper end of the water heating tank. The internal flange extends radially inward of the internal diameter of the water heater tank for engaging the upper transverse wall section of the fire tube unit. The resilient seal means is preferably an 0-ring type seal with is seated within an 0-ring groove provided in a selected one of the internal flange and the upper transverse wall section of the fire tube unit.

Most preferably, only the external flange located adjacent the initially open bottom end of the water heater tank is bolted to the fire tube unit. The upper transverse wall section of the fire tube unit is sealingly engaged by the resilient seal means located between the upper transverse wall section of the fire tube unit and the flange means located adjacent the initially open end of the water heater tank.

In manufacturing the improved water heater of the invention, the interior of the water heater tank and the exterior of the fire tube unit can be coated with a corrosion resistant material prior to assembling the fire tube unit within the internal diameter of the water heater tank. The previously coated fire tube unit is then inserted within the interior of the water heater tank until the upper transverse wall section of the fire tube unit engages the resilient seal means provided between the upper flange means and the upper transverse wall section. The lower transverse wall section of the fire tube unit is bolted to the flange means provided adjacent the lower end of the water heating tank. Because of the modular nature of the assembly, the fire tube unit can be coated by means of an electrostatic powder coating prior to installing the fire tube unit within the interior of the water heater tank.

Additional objects, features and advantages will be apparent in the written description which follows.

DETAILED DESCRIPTION OF THE INVENTION

Figure 1:
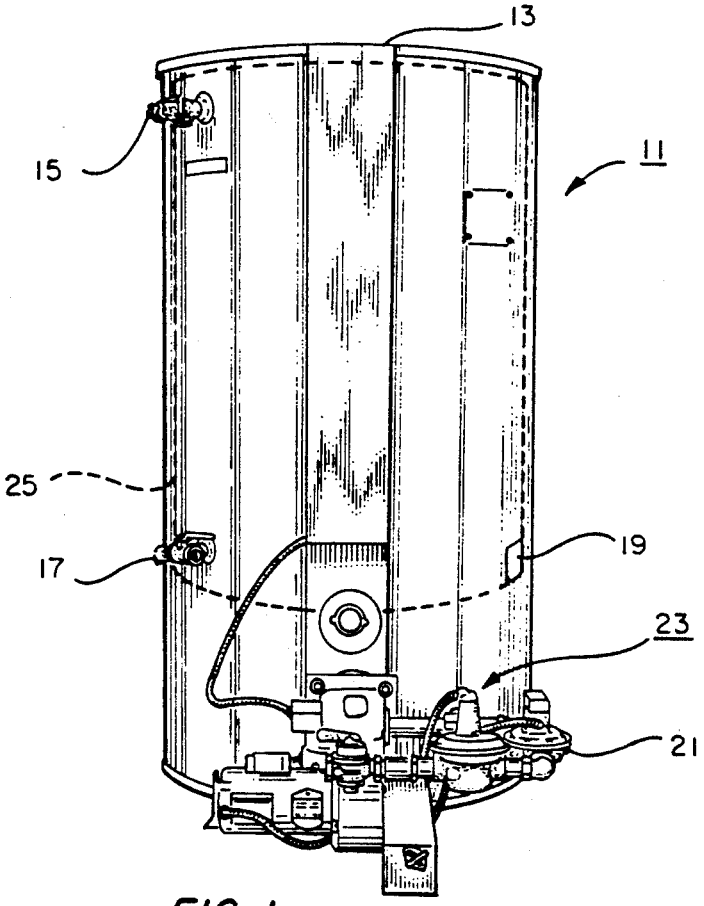
FIG. 1 is a perspective view of an assembled water heater of the invention, the water heater tank being illustrated in dotted lines.

The numeral 11 in FIG. 1 of the drawing designates a water heater having a flue outlet 13 and an ASME rated relief valve 15 in an upper region. A drain valve 17 and an inlet and relief connection 19 are shown near a lower region, as is a standard natural gas inlet 21 and pressure regulating and flow control system 23.

As illustrated in dotted lines in FIG. 1, there is located within the water heater 11 a water heater tank 25 which includes a cylindrical sidewall 27 (see FIG. 3) having an interior which defines an internal diameter 29 and initially open upper and lower ends 31, 33.

A conventional combustion chamber 35 (illustrated in phantom lines in FIG. 3) is connectable to the water heating tank. A burner 37 (illustrated schematically in FIG. 3) is provided in the combustion chamber 35 for the combustion of a selected fossil fuel.

Figure 2:
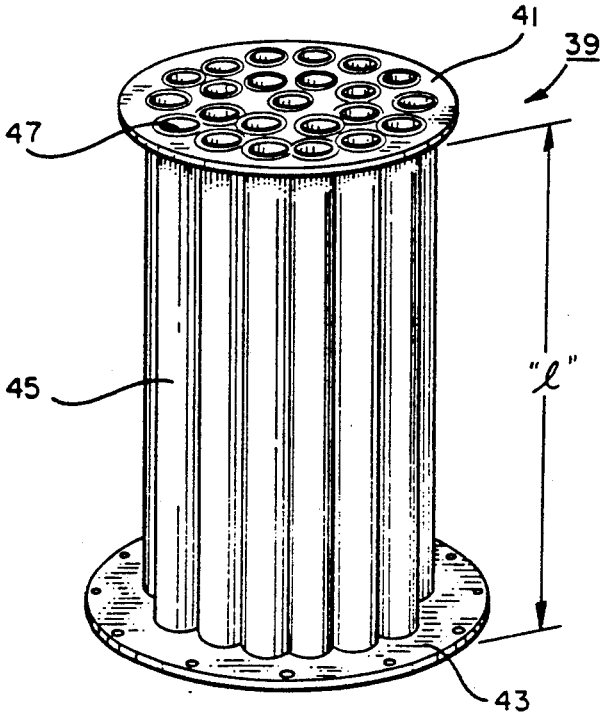
FIG. 2 is a perspective view of the isolated fire tube unit which is assembled, in modular fashion, within the surrounding shell of the water heater tank.

Turning to FIG. 2, there is shown a fire tube unit 39 of a fixed length "l". The fire tube unit 39 has an upper transverse wall section 41, a lower transverse wall section 43 and a plurality of interconnecting fire tubes 45. The 0.D. of the lower transverse wall section 43 is slightly greater than the 0.D. of the upper transverse wall section 41. Each of the interconnecting fire tubes 45 has an open interior 47, the open interiors of the fire tubes being adapted to receive the products of combustion from the combustion chamber 3 when the combustion chamber is connected to the water heating tank 25. The fire tubes 45 can be connected to the upper and lower transverse wall sections 41, 43 by welding the respective opposing ends thereof within apertures provided within the respective wall sections.

Flange means are located adjacent the initially open upper end 31 and lower end 33 of the water heating tank 25 for securing the fire tube unit within the interior of the water heater tank. The flange means can include an external flange 49 (FIG. 3) located adjacent the initially open lower end 33 of the water heating tank. The external flange 49 is preferably provided with connecting means, such as bolt holes 51 (FIG. 5) for receiving connecting bolts (not shown) which bolt the external flange 49 to the lower transverse wall section 43 of the fire tube unit.

Figure 5:
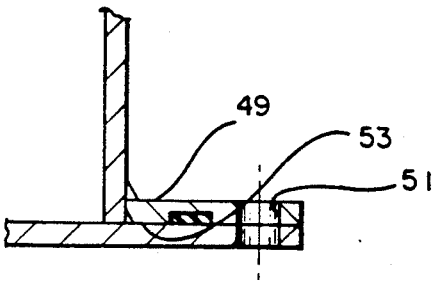
FIG. 5 is a similar view of the lower flange of the water heater tank sealingly engaging the lower transverse wall section of the fire tube unit.

As best seen in FIG. 5, the external flange 49 may be provided by a welded connection. The flange underside 53 can be provided with a groove 55 for receiving a resilient seal means, such as the 0-ring type seal 57 shown in FIG. 5 for providing a water tight connection.

Figure 3:
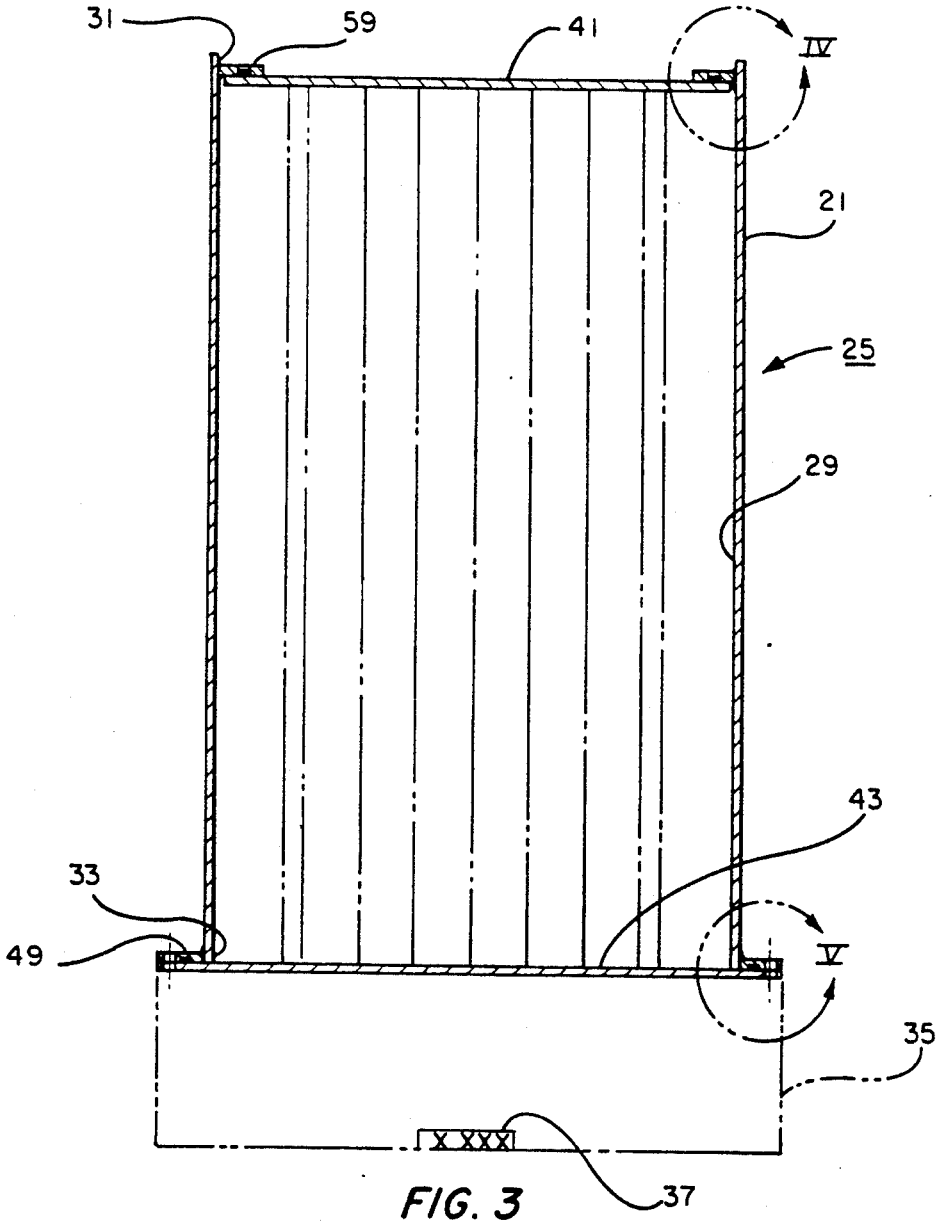
FIG. 3 is a simplified, side cross-sectional view of the water heater tank of the water heater of FIG. 1 showing the upper and lower flanges which are welded on for engaging the upper and lower transverse wall sections of the fire tube unit.
Figure 4:
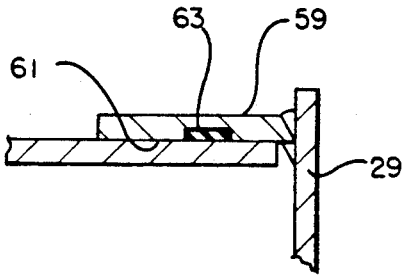
FIG. 4 is a partial, isolated view of the welded upper flange sealingly engaging a portion of the upper transverse wall section of the fire tube unit.

In the embodiment of the invention shown in FIGS. 3-5, the flange means also includes an internal flange 59 which is provided adjacent the initially open upper end 31 of the water heating tank. The internal flange 59, as shown in FIG. 3, extends radially inward of the internal diameter of the water heater tank 25 and provides a lower sealing surface ( 61 in FIG. 4) for engaging the upper transverse wall section 41 of the fire tube unit. In the embodiment of the invention illustrated in FIG. 4, the internal flange 59 is a welded connection located within the internal diameter of the cylindrical sidewall 27 and includes a circumferential groove 63 for receiving a 0-ring type resilient seal to form a water tight connection. However, unlike the lower, external flange 49, the internal flange 59 is not bolted or otherwise secured to the upper transverse wall section 41.

The length "l" of the fire tube unit 39 is sized to match the dimensions of the tank 25, as closely as possible. However, in the past, it was generally not possible to assemble the components of the tank in modular fashion because of manufacturing tolerances. However, by selectively sizing the 0-ring seal which is received within the groove 63 in internal flange 59, the resilient seal means can be deformed upon assembly to accommodate dimensional tolerances which occur between the fixed length "l" in FIG. 2 of the fire tube unit and the water heater tank 25, allowing the tube sheet unit to be installed in modular fashion.

Figure 6:
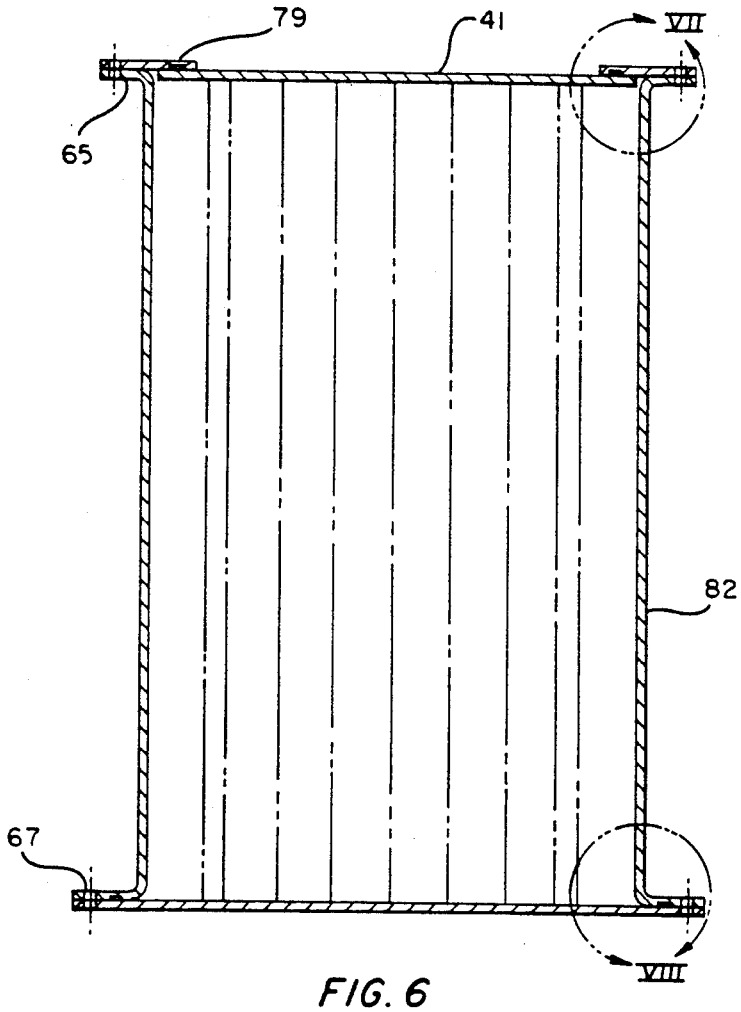
FIG. 6 is a simplified view, similar to FIG. 3 in which the upper and lower flanges of the water heater tank are formed by rolling the tank ends.
Figure 7:
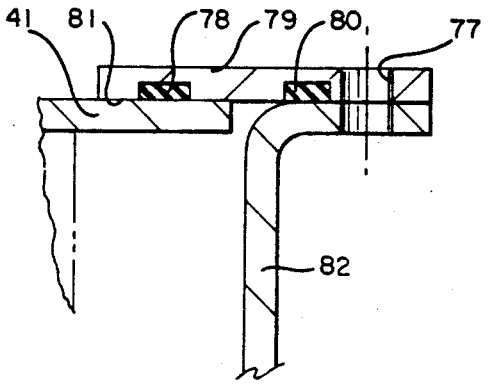
FIG. 7 is a partial, isolated view of the rolled upper flange and connected retaining ring which sealingly engage the upper transverse wall section of the fire tube unit.
Figure 8:
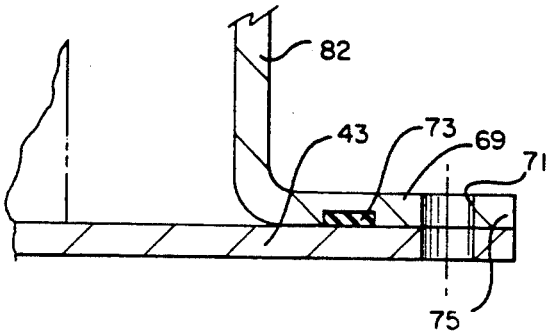
FIG. 8 shows the lower rolled flange sealingly engaging the lower transverse wall section of the fire tube unit.

FIGS. 6-8 illustrate another embodiment of the improved water heater of the invention in which the flange means located adjacent the initially open upper and lower ends 31, 33 of the water heating tank are formed by rolling the tank cylindrical sidewalls outwardly to form an outward, radial protrusion 65, 67 at the respective upper and lower ends thereof. The external flange 69 (FIG. 8) is again provided with bolt holes 71 for receiving connecting bolts which bolt the external flange to the lower transverse wall section 43 of the fire tube unit. An O-ring type seal located between the groove 73 and the upper surface 75 of the wall section 43 provides a water tight seal.

In the embodiment of the invention illustrated in FIGS. 6-8, the outward radial protrusion 65 at the tank's upper end is also provided with bolt holes 77 for receiving connecting bolts which bolt the external flange to mating holes provided on a rigid retaining ring 79 which overlays and is sealingly connected to the upper flange of the water heater tank. The rigid retaining ring has an interior portion with an underside 81

(FIG. 7) which overlays the internal diameter of the initially open end of the water heater tank. Resilient seal means (in this case O-ring 78) seals the upper transverse wall section 41 of the fire tube unit to the underside 81 of the rigid retaining ring 79 when the fire tube unit is received within the interior of the water heating tank. The resilient seal means can again be selectively sized to accommodate dimensional tolerances which occur between the fixed length of the fire tube unit and the water heater tank. Another O-ring seal (80 in FIG. 7) provides a seal between the rigid retaining ring 79 and the tank sidewalls 82.

In addition to providing a modular design for a vertical tube tank water heater, the present invention provides an improved means for corrosion protecting for such units. A water heater or boiler can be manufactured according to the method of the present invention by first coating the interior of the water heater tank and the exterior of the fire tube unit with a corrosion resistant material prior to assembling the fire tube unit within the interior of the water heater tank. Because the fire tube unit is assembled in modular fashion by sliding the unit within the interior of the water heater tank after coating, it is possible to use an electrostatic powder coating on the component parts.

Electrostatic deposition techniques will be familiar to those skilled in the art. Parts to be coated by electrostatic deposition are first grit blasted and degreased, then preheated to a temperature appropriate for the resin to be applied, usually over 400° F. Individual particles of resin powder are moved by compressed air through a specially designed gun where they receive a static charge. The part to be coated is grounded, producing an electrostatic field between the gun and the part. The powder particles are attracted t the part. As the particles deposit, they insulate the substrate, repelling additional powder and ensuring a uniform film. The loosely coated part is then heated in an oven to above the fusion temperature of the resin in the flow-out step.

Electrostatic coating provides excellent wrap-around and edge coverage and the final coating thickness is very uniform, even when part thickness varies. The method is well adapted for coating one side of parts and the thinner and more pinhole-free coatings that result are an improvement over fluidized-bed and slush coatings.

Where corrosion resistance is of major concern, as in the present application, epoxy powder coatings have been found to provide good dielectric strength and surface hardness. A variety of other thermoplastic powder coatings are also available. The provide corrosion resistance, wear resistance and are noncontaminating and provide an effective cost substitute for the more expensive materials such as exotic alloys, thicker linings and solid plastics. Among the thermoplastic resins used for powder coatings are FEP (fluoronated ethylenepropylene), PFA (perfluoroalkoxy), nylon, PVDF (polyvinylidene fluoride), ETFE (ethylenete trafluoroethylene), ECTFE (ethylene chlorotrifluoroethylene), PE (polyethylene) and EAA (ethylene acrylic acid). For more information on powder coatings, see "Powder Coatings Explode into the CPI", Chemical Processing, Nov. 1989.

After coating the interior of the water heater tank and the water side of the fire tube unit, the previously coated fire tube unit is inserted within the interior of the water heater tank until the upper transverse wall section 41 engages the resilient seal means. The lower transverse wall section of the fire tube unit is then bolted to the flange means provided adjacent the lower end of the water heating tank.

An invention has been provided with several advantages. Because the shell and sheet tube components of the water heater are modular in nature, they can be coated for corrosion resistance prior to assembly. In addition to providing a more even coverage, new technologies such as electrostatic powder deposition can be utilized. Because the coated surfaces are exposed prior to assembly, inspection for defects is facilitated. Should a problem arise during the life of the device, the components can be more readily disassembled and inspected for problems. By utilizing an electrostatic powder coating for corrosion protection, slush coatings having high VOC contents can be eliminated. The resilient seal means which seals the upper transverse wall section of the fire tube unit to the upper flange means when the fire tube unit is received within the interior of the water heater tank can be selectively sized to accommodate dimensional tolerances which occur between the fixed length of the fire tube unit and the water heater tank, allowing for modular assembly.

While the invention has been shown in only two of its forms, it is not thus limited but is susceptible to various changes and modifications without departing from the spirit thereof.

What is claimed is:

1. An improved water heater or boiler, comprising:

a water heating tank having a cylindrical sidewall which defines an interior with an internal diameter, and initially open upper and lower ends;

a combustion chamber connectable to the water heating tank;

a burner in the combustion chamber for the combustion of a selected fossil fuel;

a fire tube unit of a fixed length, having an upper transverse wall section and a lower transverse wall section and having a plurality of interconnecting fire tubes, each having an open interior, the open interiors of the fire tubes being adapted to receive the products of combustion from the combustion chamber when the combustion chamber is connected to the water heating tank;

flange means located adjacent the initially open upper and lower ends of the water heating tank for securing the fire tube unit within the interior of the water heater tank without bolting or otherwise fastening the upper transverse wall section of the fire tube unit within the interior of the tank; and resilient seal means for sealingly engaging a selected one of the upper and lower transverse wall sections of the fire tube unit when the fire tube unit is received within the interior of the water heating tank without bolting or otherwise fastening the upper transverse wall section of the fire tube unit within the interior of the tank, the resilient seal means being selectively sized to accommodate dimensional tolerances which occur between the fixed length of the fire tube unit and the water heater tank.

2. The water heater or boiler of claim 1, wherein the flange means includes an external flange located adjacent the initially open lower end of the water heating tank, the external flange being provided with bolt holes for receiving connecting bolts which bolt the external flange to the lower transverse wall section of the fire tube unit.

3. The water heater or boiler of claim 1, wherein the flange means includes an internal flange provided adjacent the initially open upper end of the water heating tank, the internal flange extending radially inward of the internal diameter of the water heater tank for engaging the upper transverse wall section of the fire tube unit.

4. The water heater or boiler of claim 3, wherein the resilient seal means is an o-ring type seal located between the internal flange and the upper transverse wall section of the fire tube unit.

5. The water heater or boiler of claim 4, wherein only the external flange located adjacent the initially open bottom end of the water heater tank is bolted to the fire tube unit, the upper transverse wall section of the fire tube unit being sealingly engaged by the resilient seal means located between the upper transverse wall section of the fire tube unit and the flange means located adjacent the initially open end of the water heater tank.

6. An improved water heater or boiler, comprising:

a water heating tank having a cylindrical sidewall which defines an interior with an internal diameter, and initially open upper and lower ends which terminate in rolled ends which form upper and lower external, sealing flanges;

a combustion chamber connectable to the water heating tank;

a burner in the combustion chamber for the combustion of a selected fossil fuel;

a fire tube unit of a fixed length, having an upper transverse wall section and a lower transverse wall section and having a plurality of interconnecting fire tubes, each having an open interior and opposing ends, one of the opposing ends being sealingly positioned over an aperture provided in the lower transverse wall section of the fire tube unit, the opposing respective end being sealingly positioned over an aperture provided in the upper transverse wall section, the open interiors of the fire tubes being adapted to receive the products of combustion from the combustion chamber when the combustion chamber is connected to the water heating tank;

a rigid retaining ring overlaying and sealingly connected to the upper external flange of the water heater tank, the rigid retaining ring having an interior portion with an underside which overlays the internal diameter of the initially open end of the water heater tank;

resilient seal means for sealingly engaging a selected one of the upper and lower transverse wall sections of the fire tube unit when the fire tube unit is received within the interior of the water heating tank without bolting or otherwise fastening the upper transverse wall section of the fire tube unit within the interior of the tank, the resilient seal means being selectively sized to accommodate dimensional tolerances which occur between the fixed length of the fire tube unit and the water heater tank.

7. The water heater or boiler of claim 6, wherein the resilient seal means is an o-ring type seal received within a mating groove provided in a selected one of the under side of the rigid retaining ring and the upper transverse wall of the fire tube unit.

8. The water heater or boiler of claim 6, wherein the lower transverse wall section of the fire tube unit has an external diameter which overlays the lower external sealing flange of the water heater tank, and wherein the lower transverse wall section of the fire tube unit and the lower external sealing flange of the water heater tank are provided with bolt holes and bolts for sealing engagement.

* * * * *